US005150483A

United States Patent [19]

Lochrie

[11] Patent Number: 5,150,483

[45] Date of Patent: Sep. 29, 1992

[54] AUTOMATICALLY LOWERING TOILET SEAT

[76] Inventor: Harold J. M. Lochrie, R.R. #5, Brockville, Ontario, Canada, K6V 5T5

[21] Appl. No.: 682,949

[22] Filed: Apr. 10, 1991

[30] Foreign Application Priority Data

Apr. 11, 1990 [CA] Canada ..... 2,014,345

[51] Int. Cl.[5] ..... A47K 13/10

[52] U.S. Cl. ..... 4/246.1; 4/661

[58] Field of Search ..... 4/248, 241, 251, 661

[56] References Cited

U.S. PATENT DOCUMENTS

| | | | |
|---|---|---|---|
| 752,321 | 2/1904 | Bacon | 4/251 |
| 2,011,404 | 8/1935 | Giliasso | 4/251 |
| 2,147,364 | 2/1939 | Brock | 4/248 |
| 2,410,854 | 11/1946 | Zulkoski | 4/251 |
| 2,723,400 | 11/1955 | Wilson | 4/251 |
| 4,592,097 | 6/1986 | Zimmerman | 4/251 |
| 4,835,799 | 6/1989 | Beelart, Jr. | 4/661 |
| 4,887,322 | 12/1989 | Lydon | 4/251 |
| 4,951,324 | 8/1990 | Lirette | 4/251 |

*Primary Examiner*—Henry J. Recla
*Assistant Examiner*—Robert M. Fetsuga
*Attorney, Agent, or Firm*—Dressler, Goldsmith, Shore, Sutker & Milnamow, Ltd.

[57] ABSTRACT

An attachment for a toilet seat is provided which ensures that a toilet seat may not be left in the upright position. An arm attaches to one side of the toilet seat and projects downwardly outside the toilet bowl. The toilet seat is arranged so that it will always fall forward from any position due to the force of gravity on the seat and the leverage caused by the weight of the arm. An optional stop mechanism is provided to limit the rearward travel of the toilet seat to ensure that the seat will always fall forward. In use, the toilet seat is held in the upright position by resting the arm against the user's leg.

18 Claims, 3 Drawing Sheets

AUTOMATICALLY LOWERING TOILET SEAT

BACKGROUND OF THE INVENTION

This invention relates to toilet seats for human use and means for ensuring that such toilet seats are always in the horizontal position after use.

The commonly available type of toilet seat consists of a seat and lid, both of which are hinged and attached at the rear of the toilet bowl in order that the lid or the lid and seat together may be elevated to the vertical position to rest against the toilet tank mounted behind the toilet bowl. This is a convenient means of providing a toilet seat which can be used in the horizontal position by either males or females and which can also be raised for cleaning purposes or for use by males. Thus, the standard toilet seat is a well designed and convenient to use apparatus, which is functional and yet which may be covered and therefore made more aesthetically pleasing by lowering the toilet lid after using.

One disadvantage of the arrangement described above is that either the lid or the lid and toilet seat together may be left in the upright position after use. This is a disadvantage in that it is considered unsightly by many and can be a nuisance to have to lower the toilet seat before use. In addition, a more serious problem exists in that if an individual forgets to lower the toilet seat before sitting down on the toilet, inconvenience and nuisance to the user may result at best, and at worst, the user risks sustaining injury from the unexpected fall.

SUMMARY OF THE INVENTION

The present invention seeks to remedy this problem by providing a toilet seat which can only rest in the horizontal position and which, for use in the upright position, must be held by the user in that upright position while in use. By preventing the toilet seat from ever being rested in the upright position, the problems described above are avoided.

There is thus disclosed an automatic seat lowering mechanism for a toilet seat on a toilet bowl comprising arm means having a first end adapted to be attached to an outer edge position of a toilet seat and to project downwardly away from the plane of the toilet seat so as to be disposed clear of the toilet bowl, and having a second end adapted to be supported by a leg of a user whereby in use, the toilet seat is held in an upright position by the second end of the arm means being supported by the leg of the user, and whereby the toilet seat will fall under the force of gravity acting on the arm means or on the toilet seat and the arm means in combination when the second end of the arm means is not supported by the leg of the user.

According to another aspect of the invention, there is disclosed an automatic seat lowering mechanism for a toilet seat with or without a toilet lid on a toilet bowl comprising arm means having a first end adapted to be attached to an outer edge position of a toilet seat and to project downwardly away from the plane of the toilet seat so as to be disposed clear of the toilet bowl, and having a second end adapted to be supported by a leg of a user, overbalancing means adapted to be positioned to stop the toilet seat or toilet lid from being raised into an upright position beyond a point where the toilet seat will remain in the upright position without support due to the force of gravity acting on the arm means or on the toilet seat and the arm means in combination, whereby in use, the toilet seat is held in an upright position by the second end of the arm means being supported by the leg of the user, and whereby the toilet seat will fall under the force of gravity acting on the arm means or on the toilet seat and the arm means in combination when the second end of the arm means is not supported by the leg of the user.

BRIEF DESCRIPTION OF THE DRAWINGS

The invention will now be described with reference to the accompanying drawings, in which.

DETAILED DESCRIPTION OF THE INVENTION

Figure 1:
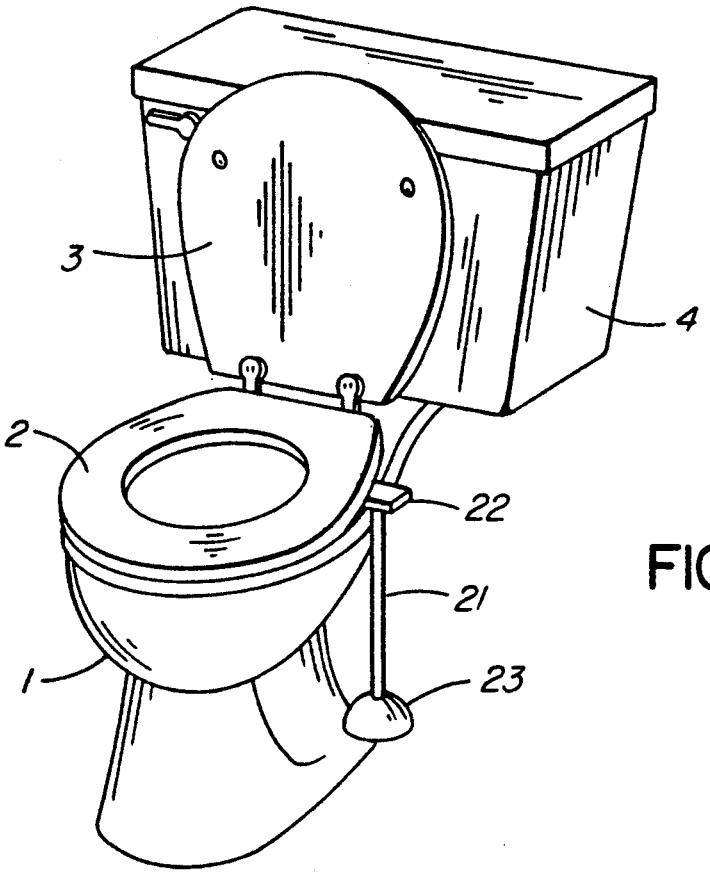
FIG. 1 is a perspective view of the apparatus of the invention installed on the toilet seat.

Referring to FIG. 1, a toilet 1 and toilet seat 2 of conventional design are illustrated. Toilet lid 3 is shown in the raised position resting against the front of toilet tank 4.

Figure 2:
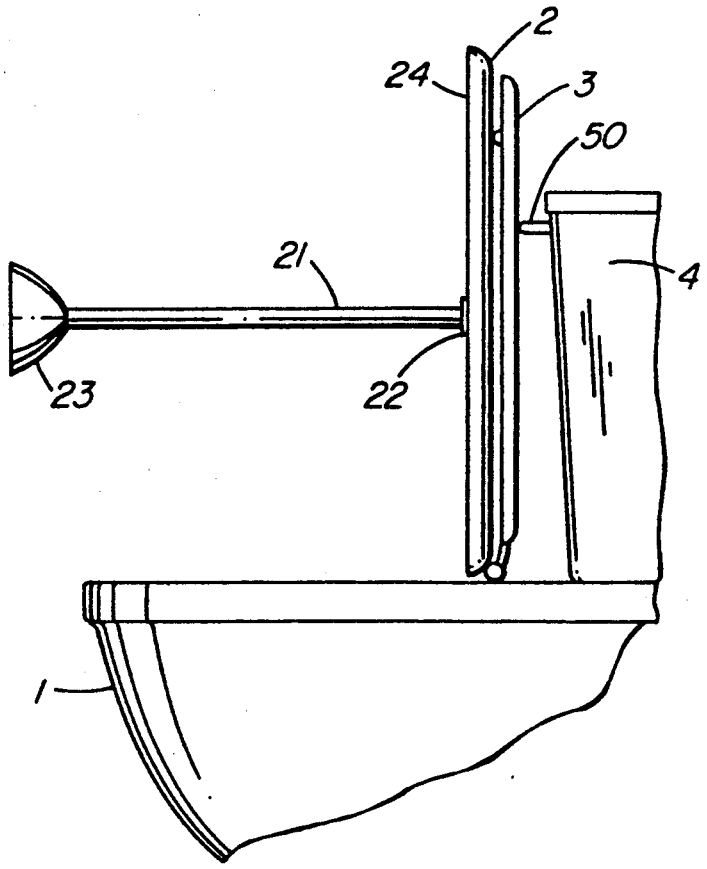
FIG. 2 is a perspective view of the apparatus of the invention when held in the upright position.
Figure 3:
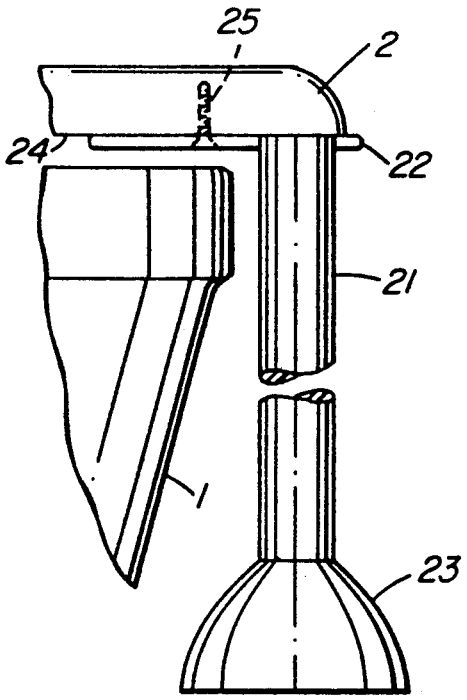
FIG. 3 is a view in section illustrating one possible means of attaching the arm to the toilet seat.

In one embodiment of the invention, the apparatus of the invention consists of an arm 21, a flange 22 to which the arm is connected at one of its ends and a foot 23 at the other end of the arm. As shown in FIG. 3, the flange 22 of the invention is attached to the underside 24 of the toilet seat at one side of the seat as illustrated in FIGS. 1 and 2. The attachment to the toilet seat 2 can be done by any convenient means such as with screws 25 and/or glue between the top of the flange and the bottom of the seat.

Foot 23 may be optionally attached to the opposite end of the arm 21 for the comfort of the user, although this is by no means necessary to the functioning of the invention. In a preferred embodiment however, the foot is provided and it is advantageous to cause this foot to be weighted in order to provide more leverage about the hinge of the toilet seat.

To install the invention, the arm is attached to the side of a toilet seat as shown in FIG. 1, preferably about half way along one side between the front of the toilet seat and the toilet seat hinge at the rear. The point of maximum rotation of the toilet seat away from the horizontal is checked to ensure that the toilet seat will always fall of its own accord due to the effect on the toilet seat of gravity acting on the toilet seat, arm and foot if present. If necessary, an additional stop is installed as described hereinafter to ensure that the toilet seat will fall under the influence of gravity from any possible position into which it is capable of being placed.

Thus, through a combination of the weight of the arm and any associated foot with or without extra weight, and an optional stop mechanism where necessary, the toilet seat is installed in such a fashion that it is always overbalanced and must always fall forward.

In operation, when it is desired to use the toilet seat in the down position, the invention has no effect and causes no inconvenience to the user. However, when it is desired to use the toilet seat in the upright position, the toilet seat 2 may be swung upwardly either by grasping the seat itself or by grasping arm 21. When in the maximum upright position, the top of the toilet lid is prevented from further angular rotation about its hinge, for example by the wall of the toilet tank or by stop 54 if it is installed. In this position, arm 21 and foot 23 project outwardly towards the user. In a preferred embodiment, foot 23 is provided to rest comfortably against the user's leg allowing the user to support the seat without the use of his hands. When the user is finished, the seat may be lowered in the normal fashion. In the unlikely event that the user forgets to lower the seat, the leverage provided by the weight of the arm and foot coupled with any extra overbalancing of the seat provided by the optional stop mechanism will act to cause the seat to fall. However, as the seat is always pressing against the user's leg by means of the arm and foot, it is most unlikely that the user would forget to lower the seat.

If required in order to cause the toilet seat to fall under the influence of gravity alone, the overbalancing mechanism may be installed as shown in FIG. 2 and adjusted as desired by means of the threaded adjustable stop 54 to prevent either the toilet seat alone or the toilet seat and the lid from remaining in the upright position. When in the maximum upright position, the top of the toilet lid contacts the end of the adjustable stop 54.

Figure 5:
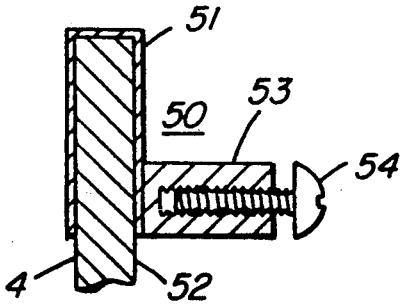
FIG. 5 is a sectional view of the adjustable stop mechanism.

FIG. 5 illustrates one embodiment of an overbalancing mechanism of the invention. Clip 51 is designed to clip over the front wall 52 of the toilet tank 4. Threaded receptacle 53 is attached to clamp 51 and is designed to provide a receptacle for threaded adjustable stop 54. By threading the adjustable stop 54 in or out as required, the point of maximum angular displacement of the toilet seat/lid assembly from the horizontal position can be adjusted such that either the toilet seat alone or both the toilet seat and the lid in combination with the leverage introduced by the arm are overbalanced and thus unable to remain upright. Instead, they will be constrained by the force of gravity to fall downward.

Figure 7:
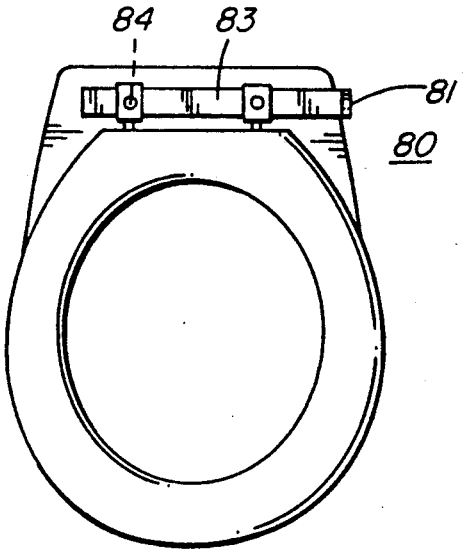
FIG. 7 is a view of a toilet showing an alternative embodiment of a stop means for overbalancing the toilet seat.
Figure 8:
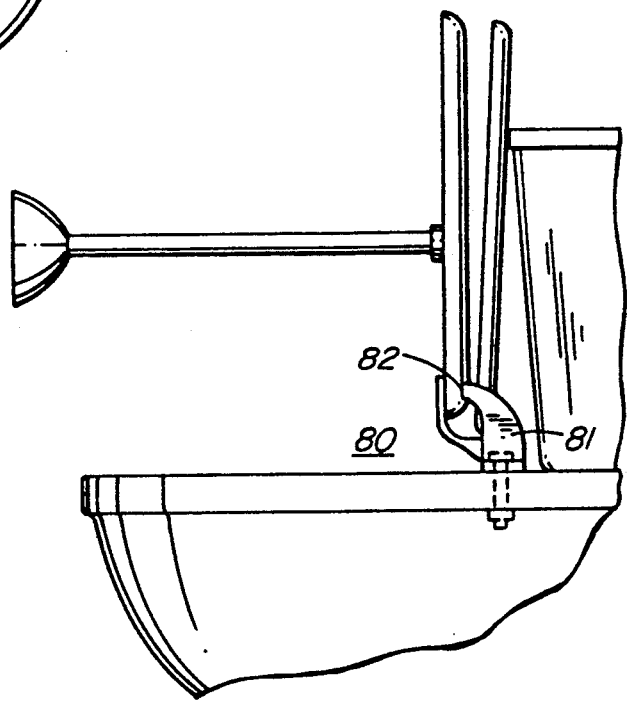
FIG. 8 is an elevation view of the embodiment of FIG. 7.
Figure 9A:
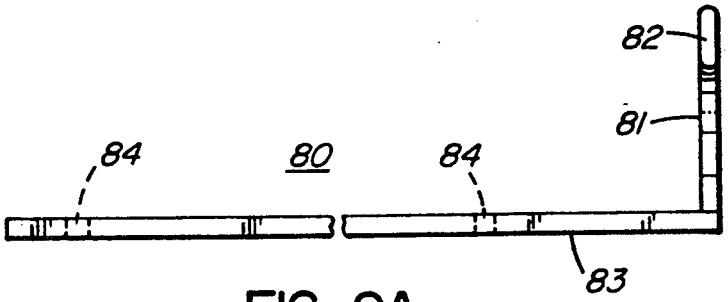
FIGS. 9*a* and 9*b* are a front elevation view and an end elevation view respectively of the embodiment of FIG. 7 showing in greater detail the construction of the alternative embodiment of the stop means.
Figure 9B:
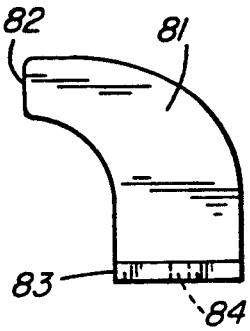

FIGS. 7, 8, 9*a* and 9*b* illustrate another embodiment 80 of an overbalancing mechanism. In this embodiment, a flat strip 83 of metal is provided which is bolted on to the toilet bowl through two holes 84 provided in the strip with the same two bolts that hold the toilet seat assembly to the toilet. A fixed arm 81 is provided on one end of the strip 83, and is arranged to stop the toilet seat when it is in the raised position by contact with the stop 82 such that the leverage of the arm and foot will still be sufficient to drop the toilet seat. In order to provide for adjustment of the position of the fixed arm 81 with respect to the position of the toilet seat during installation, the holes 84 may be made as elongated slots (not shown) extending from left to right as seen in FIGS. 7 and 9*a*. This will permit some latitude in positioning of the strip during installation in order that the fixed arm 81 is aligned properly with the toilet seat to provide a stop as described above.

In many instances, the overbalancing mechanism such as shown at 50 or 80 will not be required, where, for example, toilet seat covers are used on the toilet lid which themselves have the effect of overbalancing the toilet seat. As well, the leverage on the toilet seat introduced by the weight of the arm and foot will tend to cause the toilet seat to return to its horizontal resting position on the toilet bowl, even when the seat is raised beyond the vertical position. Thus, in many installations, an overbalancing mechanism will not be required as the leverage provided by the arm and foot will accomplish this function.

The foot 23, though not strictly necessary for the functioning of the invention, is provided in order to avoid any discomfort on the part of the user from the end of the arm 21 sticking into the user's leg. The foot is preferably arranged in such a way that a child cannot gain a foothold on it to climb up on the toilet. Accordingly, as shown in the drawings, the foot has been provided with a shoulder 26 for this purpose.

It has been found that a total length for the arm and foot of approximately 8 inches seems most appropriate. Although not shown in the drawings, it is anticipated that the arm 21 could optionally be made adjustable in length in order to suit the convenience of users. This adjustment could be provided by making the arm 21 from two separate arms, one threadably engaging the other. Alternatively, the arm could be made of two pieces telescoping one within the other and be provided with a clamp to secure the arm at the desired length. At the same time, it is desirable that there be a clearance if possible between the bottom of the device and the floor in order that the apparatus of the invention not interfere with normal floor cleaning activities.

When the arm is approximately 8 inches in length and is attached to the edge of a standard household toilet seat along one side approximately midway between the front of the seat and the toilet seat hinge at the rear, it has been found that a weighted foot of about 5 to 7 ounces is generally sufficient to effect overbalancing of the seat in most installations, without the need to provide a separate overbalancing mechanism as shown in FIG. 5, by way of example.

The arm and the foot should preferably be made of non-toxic material in view of the possibility of children attempting to put their mouths on the apparatus.

Figure 4:
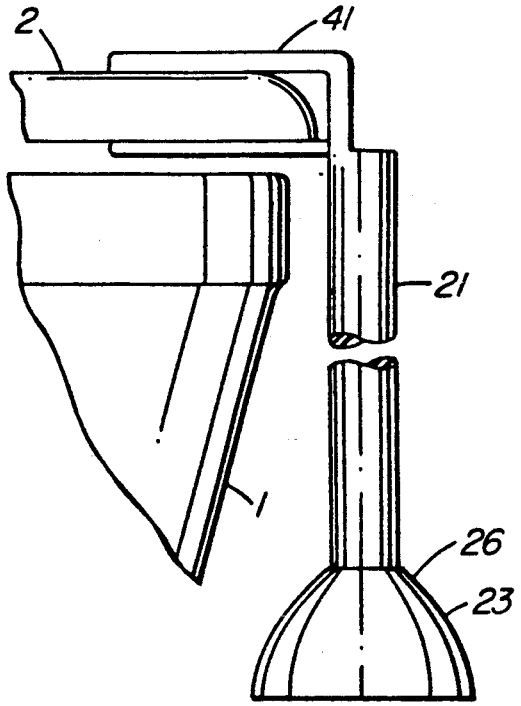
FIG. 4 is a view in section illustrating another possible means of attaching the arm to the toilet seat.
Figure 6:
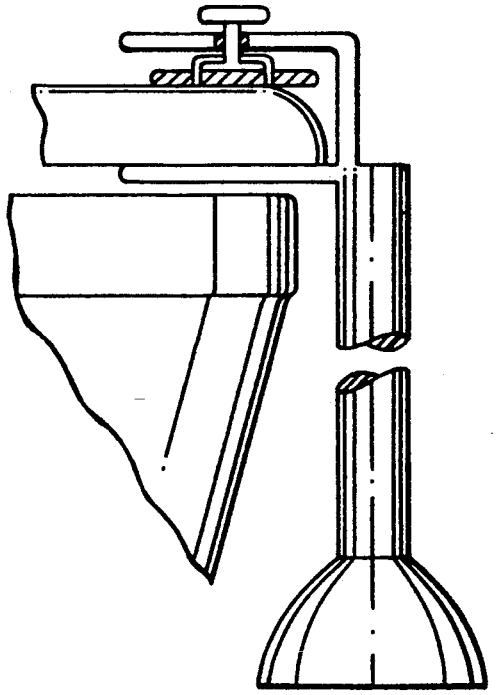
FIG. 6 is a view in section illustrating another possible means of attaching the arm to the toilet seat.

The arm may be attached to the toilet seat in a number of ways other than that described above. For example, the arm could be attached to the seat by means of a friction clip 41 as shown in FIG. 4 or by means of a thumbscrew or setscrew type of arrangement as is shown in FIG. 6.

The arm and the flange can be formed of a one piece moulded plastic if desired, or could be attached together by means of gluing, screws or by the arm threadably engaging the flange.

The overbalancing mechanism described herein may also be attached directly to the front of the toilet tank without the use of a clip, as by gluing or sticking it to the ceramic front face of the tank.

The invention is designed to improve the aesthetics of the toilet, and to this end, would be provided in tasteful colours to match the decor of the seat and lid.

It is to be understood that the scope of the invention is not to be restricted to the embodiments described above but is to be interpreted in light of the claims which follow.

What I claim as my invention is:

1. An automatic seat lowering mechanism for a toilet seat pivotally mounted on a toilet bowl comprising:

arm means having a first end adapted to be attached to an outer edge portion of a toilet seat, the arm means projecting downwardly away from the plane of the toilet seat so as to be disposed clear of the toilet bowl when the toilet seat is in a horizontal position, and having a second end adapted to be supported by the front of a leg of a user when the toilet seat is in a generally upright position, the arm means being of sufficient length to extend between the toilet seat and the front of the user's leg to permit the toilet seat to be maintained in the generally upright position to allow use of the toilet from a standing position, whereby in use, when the toilet seat has been raised by the user from the horizontal position, the toilet seat will fall under the force of gravity acting on the arm means or on the toilet seat and the arm means in combination when the second end of the arm means is not supported by the front of the leg of the user.

2. The mechanism as claimed in claim 1 wherein the arm means includes foot means provided at the second end of the arm means and broader in cross section than the arm means to rest against a user's leg when the toilet seat is in the raised position.

3. The mechanism as claimed in claim 2 wherein the arm means is between 7 and 9 inches in length.

4. The mechanism as claimed in claim 2 wherein the foot means weighs between 5 and 7 ounces.

5. The mechanism as claimed in claim 2 wherein the foot means has an outer surface and the arm means has an outer surface which meet at an angle sufficiently large to prevent a foothold being obtained on the foot means by a child when the toilet seat is in a horizontal position.

6. The mechanism as claimed in claim 1 wherein the arm means attaches to the toilet seat by means of a friction clip including at least two generally parallel gripping means connected to each other in a U-shaped configuration and attached to the first end of the arm means and adapted to frictionally receive a side of the toilet seat between the gripping means.

7. The mechanism as claimed in claim 1 wherein the arm means attaches to the toilet seat by means of a clip including at least two generally parallel gripping means connected to each other in a U-shaped configuration and attached to the first end of the arm means and adapted to receive a side of the toilet seat between the gripping means and secured thereto by setscrew means.

8. The mechanism as claimed in claim 1, and further including a toilet seat adapted to be pivotally secured to the toilet bowl, wherein said first end of said arm means is attached to said toilet seat.

9. An automatic seat lowering mechanism for a toilet seat pivotally mounted on a toilet bowl with or without a pivotally mounted toilet lid comprising:

arm means having a first end adapted to be attached to an outer edge portion of a toilet seat, the arm means projecting downwardly away from the plane of the toilet seat so as to be disposed clear of the toilet bowl when the toilet seat is in a horizontal position, and having a second end adapted to be supported by the front of a leg of a user when the toilet seat is in a generally upright position, the arm means being of sufficient length to extend between the toilet seat and the front of the user's leg to permit the toilet seat to be maintained in the generally upright position to allow use of the toilet from a standing position, overbalancing means adapted to be positioned to stop the toilet seat or toilet lid from being raised into an upright position beyond a point where the toilet seat will remain in the upright position without support due to the force of gravity acting on the arm means or on the toilet seat and the arm means in combination, whereby in use, when the toilet seat has been raised by the user from the horizontal position, the toilet seat will fall under the force of gravity acting on the arm means or on the toilet seat and the arm means in combination when the second end of the arm means is not supported by the front of the leg of the user.

10. The mechanism as claimed in claim 9 wherein the arm means includes foot means provided at the second end of the arm means and broader in cross section than the arm means to rest against a user's leg when the toilet seat is in the raised position.

11. The mechanism as claimed in claim 10 wherein the arm means is between 7 and 9 inches in length.

12. The mechanism as claimed in claim 10 wherein the foot means weighs between 5 and 7 ounces.

13. The mechanism as claimed in claim 10 wherein the foot means has an outer surface and the arm means has an outer surface which meet at an angle sufficiently large to prevent a foothold being obtained on the foot means by a child when the toilet seat is in a horizontal position.

14. The mechanism as claimed in claim 9 wherein the arm means attaches to the toilet seat by means of a friction clip including at least two generally parallel gripping means connected to each other in a U-shaped configuration and attached to the first end of the arm means and adapted to frictionally receive a side of the toilet seat between the gripping means.

15. The mechanism as claimed in claim 9 wherein the arm means attaches to the toilet seat by means of a clip including at least two generally parallel gripping means connected to each other in a U-shaped configuration and attached to the first end of the arm means and adapted to receive a side of the toilet seat between the gripping means and secured thereto by setscrew means.

16. The mechanism as claimed in claim 9 wherein the overbalancing means comprises clip means for clipping the overbalancing means over the top front lip of a toilet tank, threaded receptacle means attached to the clip means and adapted to project away from the front surface of the toilet tank towards the toilet seat or toilet lid when in the upright position when the clip means is clipped over the top front lip of the toilet tank, and threaded stop means adapted to be threadably engaged into the threaded receptacle means to provide a stop at an adjustable distance from the toilet tank for the toilet seat or toilet lid when the toilet seat is in the upright position.

17. The mechanism as claimed in claim 9 wherein the overbalancing means comprises stop means adapted to be attached to the front surface of a toilet tank and to project away from the front surface of the toilet tank towards the toilet seat or toilet lid when the toilet seat is in the upright position, and to provide a stop for the toilet seat or toilet lid when the toilet seat is in the upright position.

18. The mechanism as claimed in claim 9, and further including a toilet seat adapted to be pivotally secured to the toilet bowl, wherein said first end of said arm means is attached to said toilet seat.

* * * * *